US009121148B2

(12) United States Patent
Johnson

(10) Patent No.: US 9,121,148 B2
(45) Date of Patent: Sep. 1, 2015

(54) METHOD AND APPARATUS FOR CUTTING GROOVES IN A ROAD SURFACE

(71) Applicant: SURFACE PREPARATION TECHNOLOGIES, LLC, Mechanicsburg, PA (US)

(72) Inventor: H. Matthew Johnson, Shermansdale, PA (US)

(73) Assignee: SURFACE PREPARATION TECHNOLOGIES, LLC, Mechanicsburg, PA (US)

( * ) Notice: Subject to any disclaimer, the term of this patent is extended or adjusted under 35 U.S.C. 154(b) by 0 days.

(21) Appl. No.: 14/400,596

(22) PCT Filed: May 24, 2013

(86) PCT No.: PCT/US2013/042648
§ 371 (c)(1),
(2) Date: Nov. 12, 2014

(87) PCT Pub. No.: WO2013/177516
PCT Pub. Date: Nov. 28, 2013

(65) Prior Publication Data

US 2015/0132059 A1 May 14, 2015

Related U.S. Application Data

(60) Provisional application No. 61/651,787, filed on May 25, 2012.

(51) Int. Cl.

| | |
|---|---|
| ***E01C 23/00*** | (2006.01) |
| ***E01C 23/09*** | (2006.01) |
| ***E01C 23/088*** | (2006.01) |
| ***E01C 3/06*** | (2006.01) |
| ***E01C 11/24*** | (2006.01) |

(52) U.S. Cl.
CPC ..... *E01C 23/0993* (2013.01); *E01C 3/06* (2013.01); *E01C 11/24* (2013.01); *E01C 23/088* (2013.01); *E01C 23/0946* (2013.01)

(58) Field of Classification Search
CPC ..... E01C 3/06; E01C 11/24; E01C 23/0993; E01C 23/0946; E01C 23/088
USPC ..... 404/84.05–84.5, 93; 299/1.5
See application file for complete search history.

(56) References Cited

U.S. PATENT DOCUMENTS

| | | | | |
|---|---|---|---|---|
| 4,892,328 | A | 1/1990 | Kurtzman et al. | |
| 2002/0192025 | A1 | 12/2002 | Johnson | |
| 2008/0152428 | A1 | 6/2008 | Berning et al. | |
| 2009/0311045 | A1 | 12/2009 | Jurasz et al. | |
| 2012/0301220 | A1* | 11/2012 | Snoeck et al. | 404/75 |

FOREIGN PATENT DOCUMENTS

| | | | |
|---|---|---|---|
| WO | 2007144678 | A1 | 12/2007 |

* cited by examiner

*Primary Examiner* — Raymond W Addie
(74) *Attorney, Agent, or Firm* — McNees, Wallace & Nurick LLC

(57) ABSTRACT

A system and apparatus for cutting grooves in a surface includes a housing having a rotatable cutting head mounted therein. An actuator drives the cutting head out of and into contact with the surface. Sensors disposed on the housing sense a depth of the groove cut by the cutting head. A controller is arranged to receive a signal from the sensors and compare the depth of the groove with a predetermined reference depth. The controller sends a signal to the actuator and adjusts the position of the cutting head via the actuator to maintain the depth of the groove at about the reference depth.

18 Claims, 9 Drawing Sheets

METHOD AND APPARATUS FOR CUTTING GROOVES IN A ROAD SURFACE

CROSS-REFERENCE TO RELATED APPLICATIONS

This application claims the benefit of U.S. Provisional Application No. 61/651,787, filed May 25, 2012, entitled METHOD AND APPARATUS FOR CUTTING GROOVES IN A ROAD SURFACE, which is incorporated herein by reference in its entirety.

BACKGROUND

The application generally relates to a method and apparatus for cutting a groove in a road surface. The application relates more specifically to method and apparatus for cutting grooves of a precise depth in a road surface using distance sensors to provide feedback.

Road surface markings are required on paved roadways to provide signals and information for road traffic. Stripes are typically painted on either side of the road and between traffic lanes to indicate the width of the traffic lanes in which the vehicle can travel. Visibility and uniformity of road markings is important to provide consistency and certainty for driver safety.

Road stripes may be applied by traditional line painting techniques such as spraying or rolling a painted line along the road surface. More recently, reflective tapes have been used on road surfaces to provide greater visibility and uniformity than painting techniques can provide. In either case, road stripes are exposed to the effects of traffic, tire wear and road construction equipment, e.g., snow plow blades.

Intended advantages of the disclosed systems and/or methods satisfy one or more of these needs or provide other advantageous features. Other features and advantages will be made apparent from the present specification. The teachings disclosed extend to those embodiments that fall within the scope of the claims, regardless of whether they accomplish one or more of the aforementioned needs.

SUMMARY

In one embodiment an apparatus for cutting grooves in a surface includes a housing having a rotatable cutting head mounted therein, an actuator for driving the cutting head out of and into contact with the surface; at least one distance sensor disposed on the housing for sensing a depth of a groove cut by the cutting head, and a controller. The controller is arranged to receive a signal from the at least one distance sensor; compare the sensed depth of the groove with a predetermined reference depth, and adjust a position of the actuator to maintain the depth of the groove at about the reference depth. In another embodiment a method is disclosed for controlling the depth of grooves cut in a roadway be a cutting apparatus. The method includes specifying a depth dimension for a groove in a surface, the depth representing a distance between the surface and a bottom of the groove; providing at least one sensor on a cutting apparatus having a rotary cutting drum; cutting a groove with the cutting apparatus sensing a depth of the groove; transmitting a feedback signal from a sensor to a controller configured to control the depth of the groove; and adjusting an actuator in response to the feedback signal indicating a difference between the depth of the groove and a reference value.

In another embodiment a method is disclosed for controlling the depth of grooves cut in a roadway by a cutting apparatus. The method includes specifying a depth dimension for a groove in a surface, the depth representing a distance between the surface and a bottom of the groove; providing at least one distance sensor on a cutting apparatus having a rotary cutting drum; generating a signal indicative of the surface level; adjusting a position of the rotary cutting drum in response to the signal; and cutting a groove with the cutting apparatus.

In yet another embodiment a method is disclosed for controlling the depth of grooves cut in a surface by a cutting apparatus. The method includes setting a depth reference value; cutting a groove in the surface with a cutting head by controlling a feedback valve; comparing a front distance surface height reading with a rear distance groove bottom height reading corresponding to the same linear point of travel using a time delay to register the linear position of the distance readings; and adjusting the position of the cutting head in response to sensing a difference between a reference depth value and an actual depth value.

Certain advantages of the embodiments described herein include the ability to take distance readings precisely within the groove as it is cut. Another advantage is the ability to process feedback signals via computer to provide substantially instantaneous feedback control. Yet another is continuous monitoring and feedback of the groove depth as the cutting machine is cutting the groove to provide real-time adjustments. Still another advantage is the ability to precisely control the depth of a groove cut in a surface relative to the original road surface. Further advantages include averaging of depth sensor signals to account for and eliminate irregularities in the surface, and time delayed synchronization for comparing before and after heights of the surface and the groove at the same point in the line of travel.

Alternative exemplary embodiments relate to other features and combinations of features as may be generally recited in the claims.

DETAILED DESCRIPTION OF THE EXEMPLARY EMBODIMENTS

Figure 1:
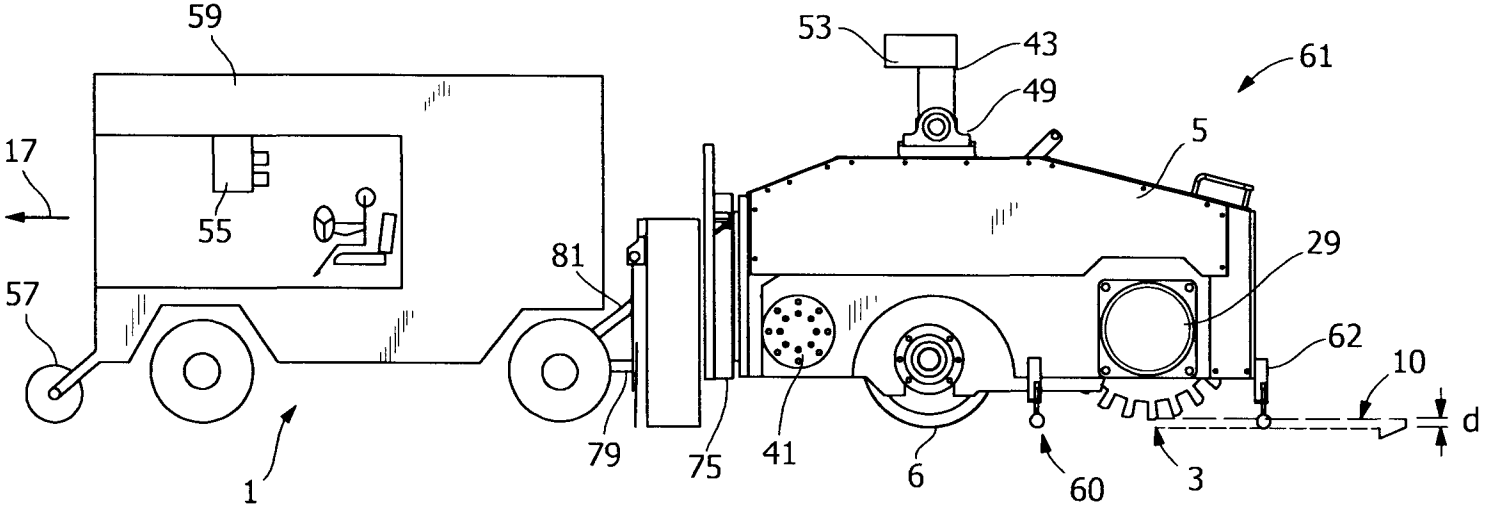
FIG. 1 is an elevational view of a cutting machine.

Referring now to the drawings, and particularly to FIGS. 1-6, a cutting machine 1 includes a conventional cutting head/drum 3 contained within a drum housing 5 having a pair of opposed, substantially parallel, vertically extending side walls 7 and 9. In addition, drum housing 5 contains front and rear parallel sidewalls 11 and 13, and plates 15 forming part of the top of housing 5. The bottom of housing 5 is substantially open. As indicated by arrow 17, in one embodiment cutting machine 1 may travel in the forward direction towing drum housing 5 behind it as drum 3 cuts a groove in the pavement surface 10. In an alternate embodiment cutting machine 1 may have drum housing 5 mounted on the front and push drum housing in front of it as drum 3 cuts the groove into pavement surface 10. Grooves may be ground or milled into the road pavement to a depth d, e.g., for placement of road stripes for traffic lane marking, center lines, directional arrows, or other similar road markings. The depth d may be any suitable depth for receiving road surface marking paint or tape, e.g., 50 mils is commonly specified for road pavement applications, although deeper or shallower grooves may be cut using cutting machine 1 and drum 3, as desired. The depth of any groove may be controlled to precise tolerances, e.g., plus or minus 10 mils, or 20%, using closed-loop feedback controls described in greater detail below.

The position of cutting drum 3 with respect to roller 6 depends on the direction of travel, i.e., whether cutting apparatus 61 is being towed behind power unit 59, as shown in FIG. 1, or whether cutting apparatus is pushed in front of power unit 59. In any event when performing surface cutting operations, roller 6 always precedes cutting drum 3 in the direction of travel. Thus the arrangement of cutting drum 3 and roller 6 in cutting apparatus 61 must be modified accordingly when cutting apparatus 61 is pushed in front of power unit 59. This may require an extension to housing 5 to accommodate a forward roller 6, as will be readily appreciated by those skilled in the art.

In one exemplary embodiment cutting drum 3 may include a plurality of grinding wheels 4 coaxially mounted on a drive shaft driven by prime movers 27, 29, for example, one or more hydraulic motors, gearboxes, pulleys. One of the prime movers 27, 29 may be a support bearing which just supports the shaft.

Figure 2:
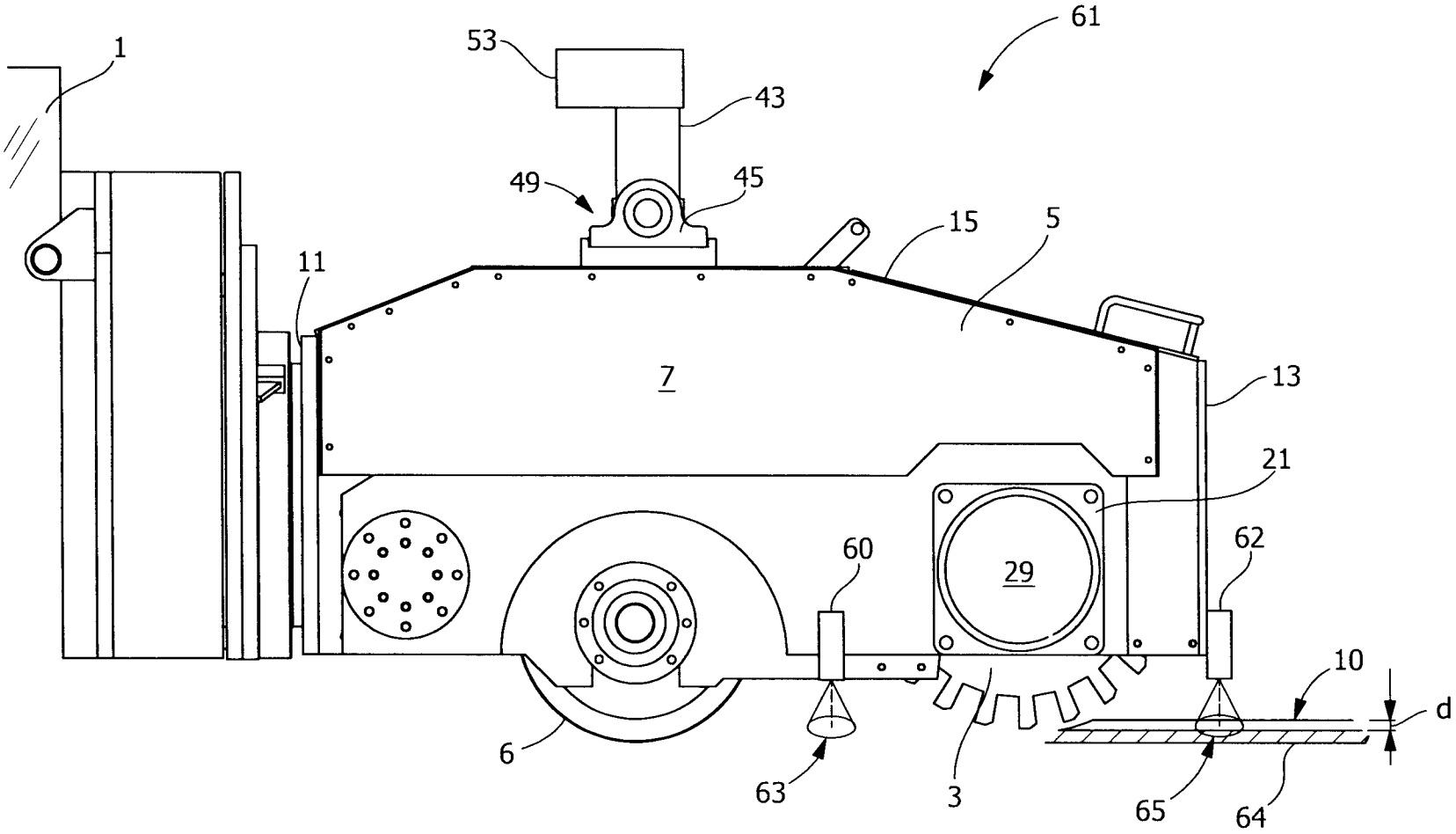
FIG. 2 is an elevational view of the cutting apparatus.
Figure 3:
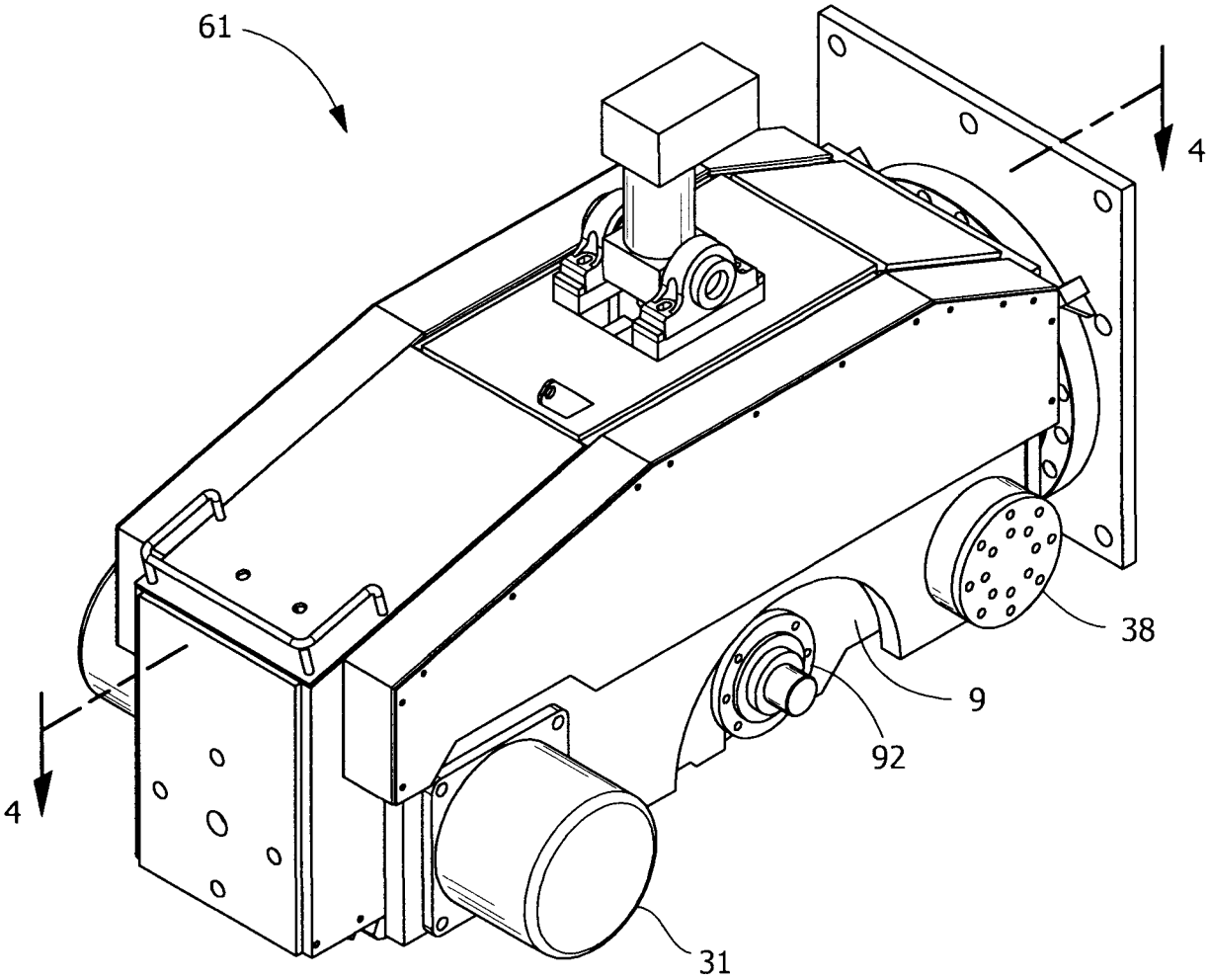
FIG. 3 is an isometric view of the cutting apparatus.
Figure 4:
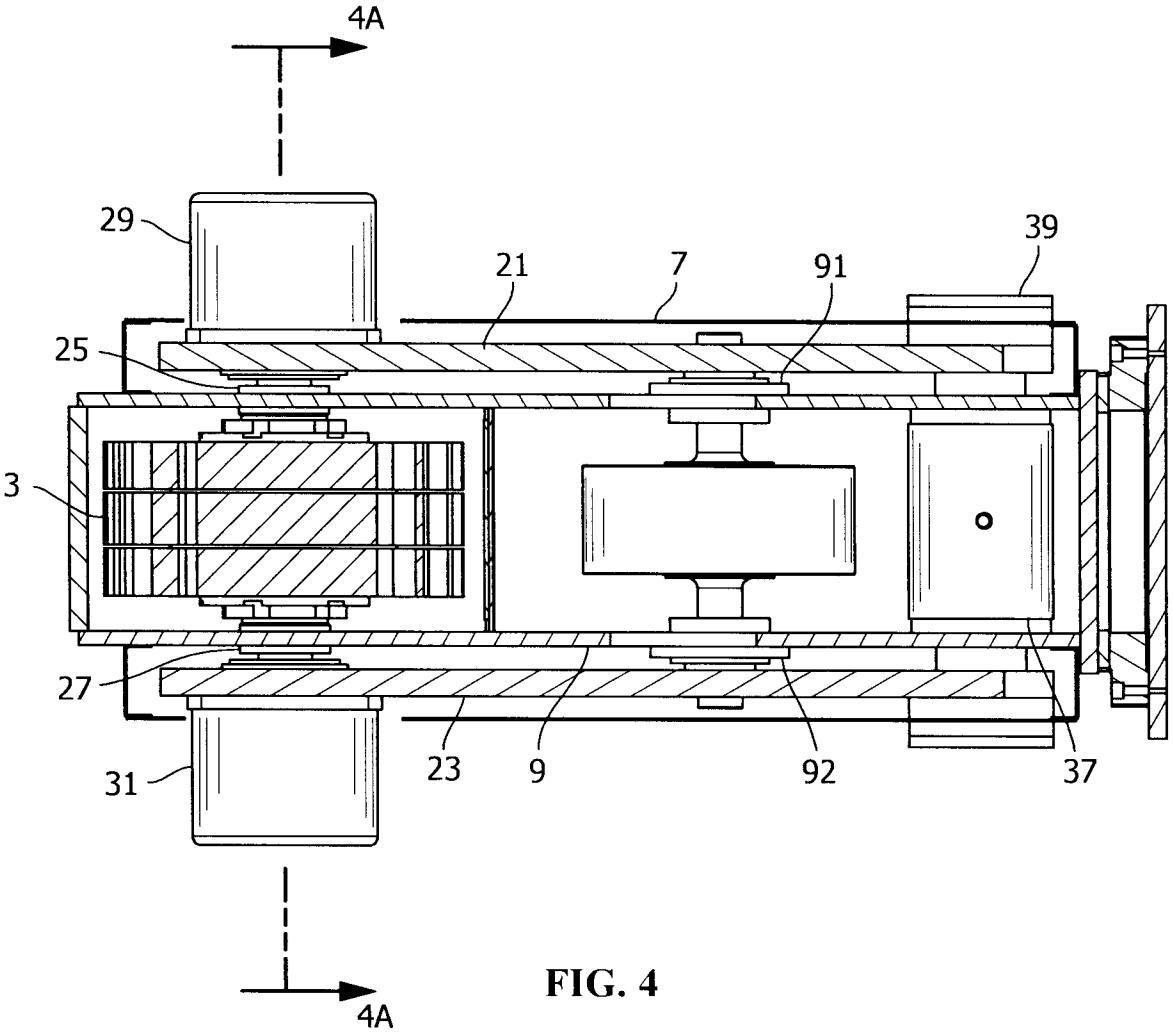
FIG. 4 is a cross-sectional plan view of the cutting apparatus taken along the lines 4-4 in FIG. 3, showing the internal arrangement of the cutting drum and rollers.
Figure 4A:
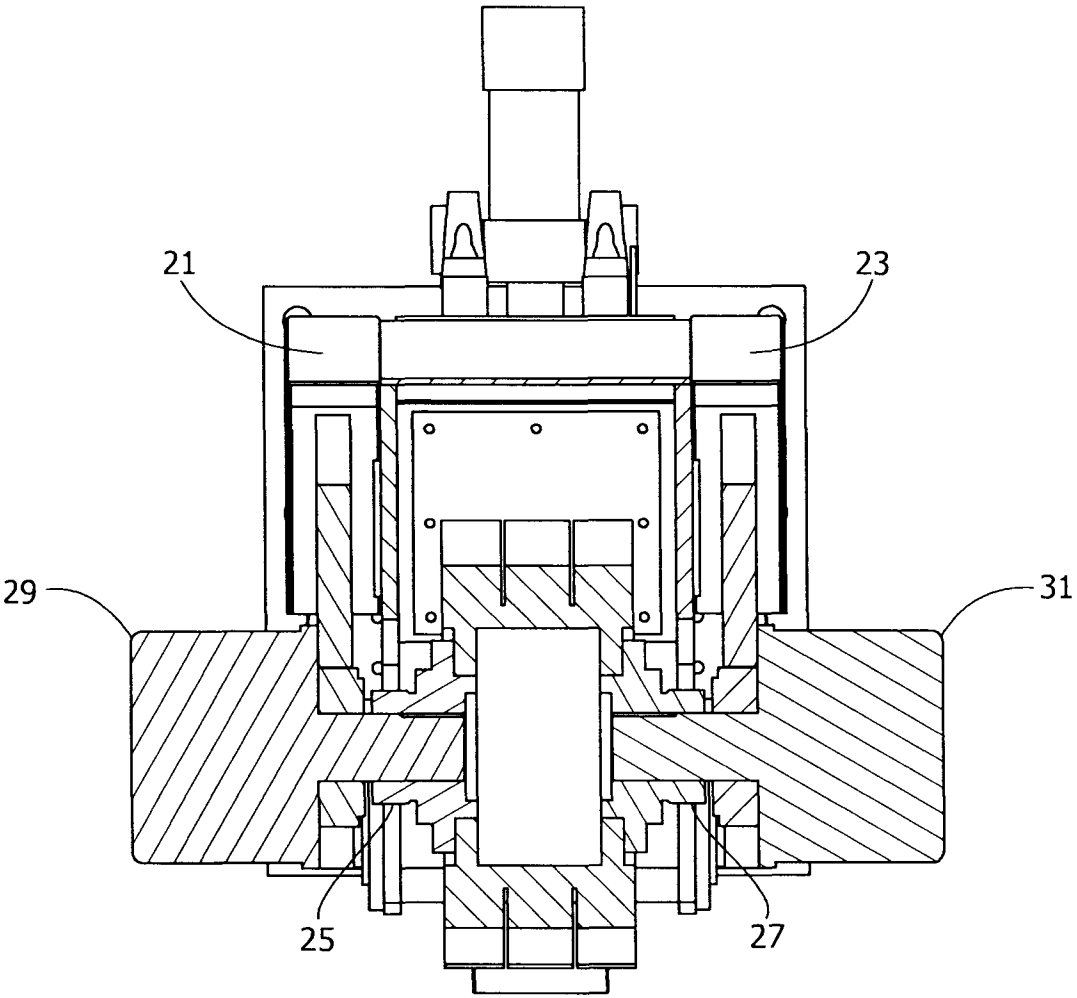
FIG. 4A is a cross-sectional view of the cutting apparatus taken along the lines 4A-4A in FIG. 4.
Figure 5:
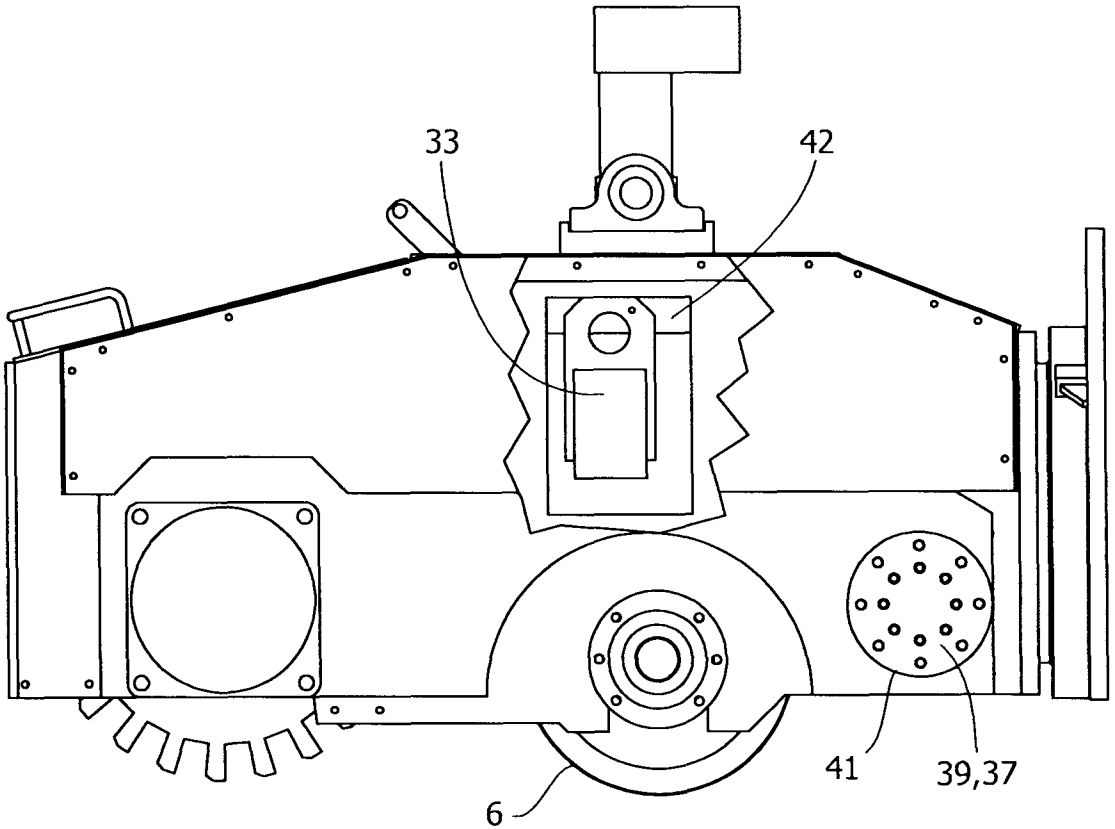
FIG. 5 is a side elevational view of the cutting apparatus.

Referring to FIGS. 2-4, the cutting drum 3 is carried within the housing 5 by two arm plates 21 and 23. The cutting drum 3 is operably coupled, e.g., via splines, keyway or equivalent, to each of the arm plates 21 and 23 through respective rotational drive units 25 and 27 which contain bearings therein. Drive units 25, 27 may include gear boxes, pulleys, chain sprockets, motors, and similar mechanical rotation units. Drive units 25 and 27 are each rigidly attached at one end thereof to the respective arm plate, which allows the opposite end of the drive units 25 and 27 to rotate the cutting drum 3. The cutting drum 3 is driven in a conventional manner by one or two prime movers 29, 31, e.g., hydraulic, electric or pneumatic motors, depending on torque and speed requirements. Prime movers 29, 31 are respectively mounted through the arm plates 21 and 23 and into a respective drive unit 25 or 27. The cutting drum 3 is rotated in a counter clockwise/up cut direction relative to a road surface. Cutting drum 3 may have tungsten carbide tipped teeth, diamond cutting bits, or other teeth/bits of suitable hardness with which to grind away the pavement surface 10. Furthermore, while a hydraulic motor driven system for the cutting heads has been described, other conventional direct or indirect drive systems can be used in lieu thereof, such as a belt or chain driven system.

Housing 5 is supported in the center by a solid steel roller 6 which is affixed to a shaft 63 which is carried by two bearings 91 and 92. The bearings 91 and 92 are bolted to a roller housing assembly which is firmly attached to the cutter housing 5.

The entire cutting tool apparatus 61 via the housing 5 is attached to a mast 75 of the power unit 59 by a slew type bearing which allows the cutting apparatus 61 to swivel horizontally. The mast 75 is also attached to the power unit 59 by hydraulic cylinders 79 and 81 (two of each, only 1 shown) and control arms (not shown). The height of the rear of the cutting tool apparatus 61 is adjusted by adjusting the mast cylinders 79. Once the height of the rear of the cutting apparatus 61 is adjusted, the lower mast cylinders 79 are pressurized in a manner which continuously tries to retract the bottom of the mast 75 toward the power unit 59. This feature has the affect of transferring the weight of the power unit 59 to the cutting apparatus 61, and thereby continuously forces the roller 6 into maintaining contact with the road surface.

The weight transfer process discussed above allows for the weight of the power unit 59 to be transferred to the cutter housing 5. As much weight as possible must be applied on the housing 5 in order to ensure that the cutting drum 3 will be driven and held against the road surface during the required cutting cycle by the hydraulic cylinder 43. Sufficient weight is required so that the cutting cycle can be completed without the tool housing lifting up vertically.

The combination of the pressurized cylinders 79, the slew bearing and the roller assembly enables the cutting tool apparatus 61 to self align with the road surface. As the cutting apparatus 61 is pushed or pulled along the surface of the road, the roller 6 follows the horizontal plane of the road.

Due to the amount of weight placed on the cutting apparatus 61 due to the cylinders 79, the slew bearing and roller assembly, the roller 6 will almost always maintain contact across its width with whatever horizontal road plane it encounters. Since the tool cutting apparatus 61 is able to pivot horizontally about the slew bearing, the cutting apparatus 61 continuously and automatically forces the cutter housing 5 and cutting drum 3 to be parallel to the road surface. In addition, the tool mast 75 can travel vertically about the cylinders 79 and 81 via a conventional clevis type connection (not shown) that exists between the cylinders 79, 81 and the mast 75. This allows the cutting apparatus to adjust vertically if the cutting drum 3 is forced to move up or down due to a dip or rise in the road surface.

It is desirable that the cutting drum 3 be parallel to the road surface so that as the piston of hydraulic cylinder 43 extends the cutting drum 3 will engage the road surface and extend into the surface evenly across the length of the cut. The above-described leveling feature is self adjusting so that the operation of the cutting machine can meet and maintain a maximum forward speed and a maximum production capability.

The arm plates 21, 23 are interconnected at one end by the cutting drum 3 and drive mechanism described above. The arm plates 21, 23 are also interconnected by a beam 33 which is connected to each arm plate 21, 23 via bolts. The arm plates 21, 23 are also connected at the rear of the housing 5 by a shaft 37 which pivots against bearings or bushings 39, each of which are contained in a tube 41. The tube 41 may be welded to and made part of the housing 5. The combination of shaft 37, bearings 39 and tube 41 allows the cutting drum 3 and arm plates 21, 23 to pivot up and down. The up and down movement of the cutting drum 3 allows it to be engaged and disengaged with the road surface. Moreover, slots or openings 42 are provided in the side walls 7 and 9 to accommodate the movement of the beam 33. Additional slots or openings 44 which extend from the bottom edges of side walls 7, 9 allow for movement of the cutting drum 3 and drive mechanism without interference from the side walls 7, 9.

The cutting mechanism (cutting drum 3, arm plates 21, 23 and rotational drive units 25, 27) is raised and lowered by a hydraulic cylinder 43 which is attached to the top plate 15 of the housing 5 by pillow block bearings 45 and 47 and to the beam 33 at an attachment device 49. Attachment device 49 includes two lug portions. A piston of hydraulic cylinder 43 has a through opening which can be aligned with through openings in attachment device 49 such that a pin connects the hydraulic cylinder 43 to the cutting mechanism.

In operation, the operator first orientates the power unit 59 and cutting apparatus 61 over the area to be cut. The cutting drum 3 is suspended and held by the tool cylinder 43 at a hover point above the road surface. Then, the cutting drum 3 is generally orientated parallel to the road surface. The operator then engages the drive mechanism of the power unit 59 and moves the cutting apparatus 61 forward. As the power unit 59 advances, the encoder 57 instructs the computer controller 55 to begin executing its preprogrammed instructions and provides a signal to the controller 55 which is indicative of the distance traveled along the road surface. The computer controller 55, based on the signal from the encoder 57, sends signals to the proportional valve 53 which controls the movement of the piston of tool cylinder 43, such that the cutting drum 3 is vertically moved into contact with the road surface in a precise manner as it moves across the road surface. In one embodiment movement of the piston into the pavement surface may set at a rate which is proportional to the forward speed of power unit 59. In other words, the encoder continually supplies the computer with a signal indicative of detected forward movement of the power unit 59 and the computer controller 55 adjusts the piston in relation to the forward movement such that the specified groove depth is maintained.

Control of the hydraulic cylinder 43 is accomplished via an electronic proportional valve 53. The electronic proportional valve 53 is activated to either raise or lower piston of cylinder 43 according to programmed instructions from a computer controller 55. The computer controller 55 is programmed to precisely lower and raise the piston to programmed depths as the cutting drum 3 advances across the road surface. The computer controller 55 receives electronic impulses which correspond to the distance traveled by the cutting machine 1 from a distance measurement encoder 57 or other distance measurement device, disposed on a power unit 59. The power unit 59 can be, e.g., a truck or other suitable vehicle that pulls or pushes cutting machine 1. Power unit 59 provides utilities such as electricity or hydraulics to the various components of cutting machine 1. Power unit 59 also moves the entire cutting machine I along the road surface. Encoder 57 may be an optical encoder or a rotary pulse generator. For clarity, hydraulic fluid lines and electrical cables are not shown in the drawings, but it is understood that interconnecting fluid lines and electrical power and signal cables are included as needed for operation of the associated devices.

In one embodiment a laser distance sensor or sensors 60 (see FIG. 2) may be mounted on housing 5 for measuring the distance between the road surface and the cutting apparatus 61. Distance sensor 60 may be, e.g., a non-contact-type distance sensor such as a laser sensor, ultrasonic sensor, radar, sonar or similar non-contact sensor; or a contact-type distance sensor such as a mechanical transducer, roller, lever arm, or similar contact-type sensor. In the non-limiting exemplary embodiments described herein, non-contact laser sensors are employed. Laser sensor 60 is mounted forward of cutting drum 3 and aft of roller 6, and senses the road surface height relative to a fixed point on cutting apparatus 61. Laser sensor 60 transmits a signal over a data cable to controller 55 which the operator uses to calibrate the surface level before commencing a surface grinding operation. As cutting apparatus 61 travels along the road surface, elevation changes in the road surface are transmitted via laser sensor 60 to controller 55, and cutting drum is raised or lowered correspondingly to maintain a substantially constant depth of the groove 64 as it is cut into the surface.

A second, or rear, laser sensor 62 may optionally be mounted on rear sidewall 13, aft of cutting drum 3. Laser sensor 62 may be included to provide a feedback signal to controller 55 as it senses an actual distance to the bottom of groove. Dotted lines 63, 65 represent the laser beams directed at the pavement surface for measuring the height of the pavement surface before and after grinding. In one embodiment laser distance sensors 60, 62 send a laser pulse in a narrow beam towards the object and measures the time taken by the pulse to be reflected off the surface and returned to the laser sensor, and calculates the depth as the difference between the original surface and the groove surface measurements.

Rear laser sensor 62 provides a feedback signal of the actual depth of the groove cut into the surface, and enables adjustment of the cylinder or actuator to account for, e.g., tooth wear of cutting drum 3, road conditions such as variations in hardness, etc. Cylinder 43 may also be equipped with a transducer (not shown) for providing a feedback signal to controller 55 indicating a position of cutting drum 3.

In one embodiment, an initial groove depth is determined by use of a transducer, e.g., a linear position transducer, and operator calibration of the uncut surface level. The linear position transduce may be arranged on or within hydraulic cylinder 43 and transmit a signal indicative of piston movement of cylinder 43. During operator calibration, lasers are also calibrated so that the original surface level is known, i.e., establishes a zero reference point. After cutting apparatus 61 begins cutting a groove 64 in pavement surface 10, when the length of the groove exceeds the distance between lasers 60, 62, then the difference between the pavement surface height sensed by front laser sensor 60 and the groove bottom surface sensed by back laser 62 determines the groove depth. The signal from front laser 60 may be time delayed so that the same point on the surface can be compared before and after cut, i.e., front laser readings and rear laser readings may be correlated with respect to substantially the same location on the pavement surface 10. Cutting head may be continuously adjusted according to laser measurements to ensure consistent groove depth.

In one embodiment, the laser data from first laser sensor 60 and/or second laser sensor 62 may be filtered using an exponential filter to eliminate any spurious reading, e.g. a pebble on the road. In addition, an adjustable time-average of the distance measurement along a predetermined segment may be used to adjust the surface height value to improve performance for varying surface conditions. For example, an exemplary computer scan time may be approximately 2 msec, which is equivalent to 0.2 inches of travel at 500 ft/min. I.e. at 500 ft/min the computer can adjust the valve position once every 0.2 inches of travel. The controller may be configured to compensate for adjusting valve position more or less depending on the travel velocity of cutting apparatus 61.

An air duct that is connected to a blower may be provided in cutting apparatus 61 to provide a pressure pulse of air directed adjacent to the rear laser sensor 62 for clearing dust and grinding debris from the groove 64 to improve accuracy and reliability of laser data for the groove depth. Alternately a vacuum duct or water spray may be used for clearing dust and grinding debris from the groove 64.

Figure 6:
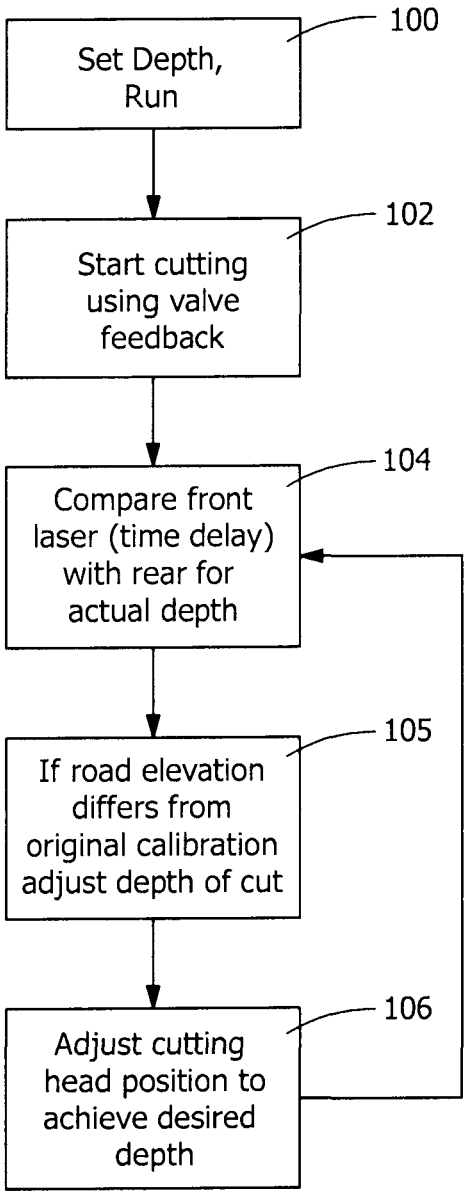
FIG. 6 is a flow diagram of one embodiment of a method for accurately controlling the depth of a groove cut into a surface.

Referring next to FIG. 6, an exemplary flow diagram of a method is disclosed. At step 100, the operator sets the depth of the cut, then calibrates the controller by lowering the cutting drum to the road surface. Upon contacting the road surface the transducers, e.g., laser sensors or Balluff transducers, are set to zero to initialize the controller. The operator then sets the cutting machine controller to RUN, so that cutting drum 3 begins grinding the pavement. Next, at step 102, the operator advances cutting apparatus 61 and begins cutting a groove in the pavement, and the controller begins receiving feedback. Next, at step 104, the controller receives a signal from front laser 60 indicative of original surface height from the first laser sensor, receives a signal from the second laser indicative of the groove bottom height, introduces a delay to the first signal based on the travel speed of cutting apparatus 61 so that the surface height and groove heights are compared for the same point along the line of travel. Then, at step 105, if the leaser sensors or transducers sense a deviation in the road elevation from the original calibration point the controller receives a feedback signal indicating the deviation and adjusts the depth of the cut accordingly. Next at step 106, in response to sensing a deviation from the desired depth of the groove, cutting drum position is adjusted up or down as needed to maintain the desired groove depth.

Figure 7:
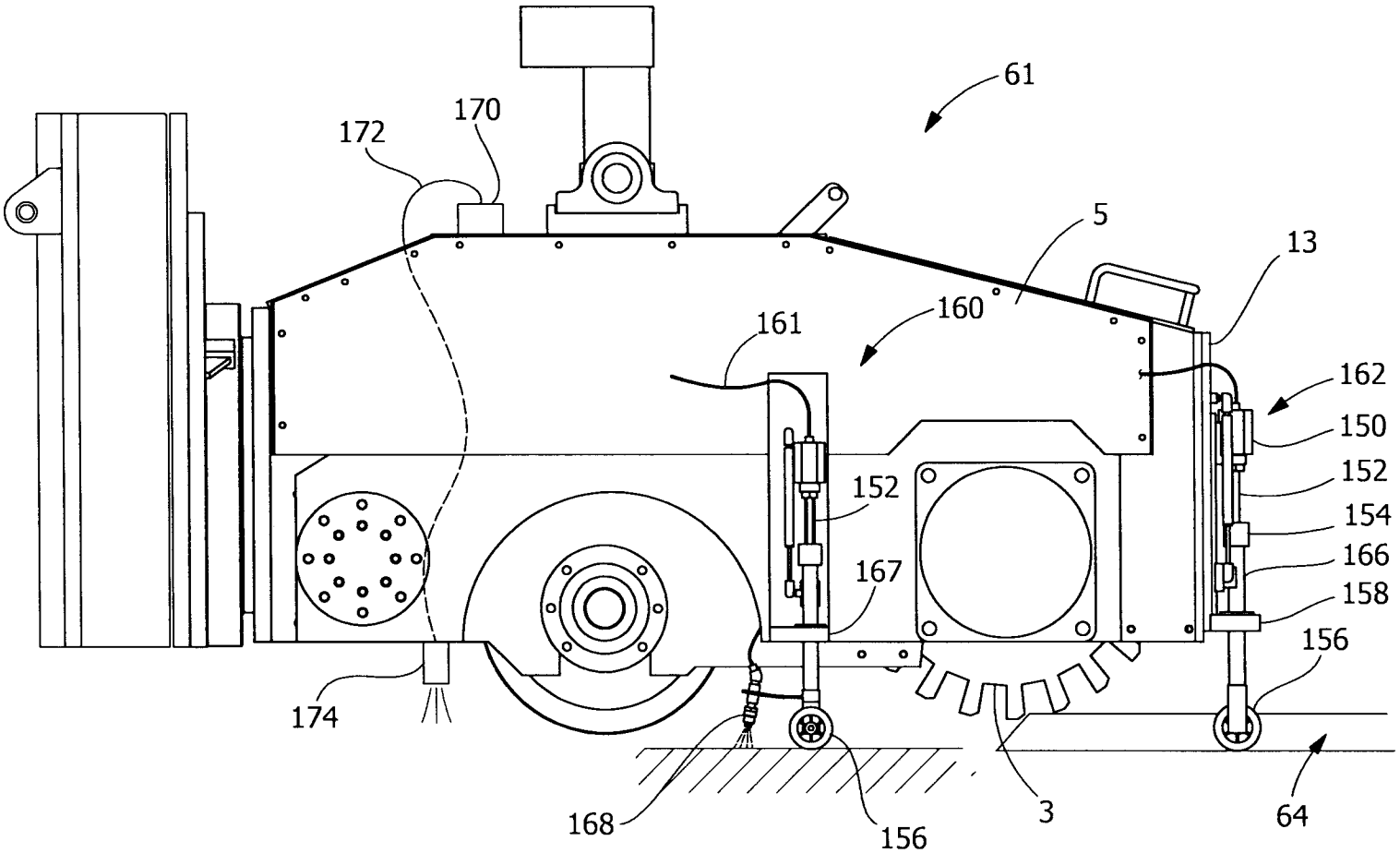
FIG. 7 shows an alternate embodiment of a cutting machine having roller type distance sensors.
Figure 8:
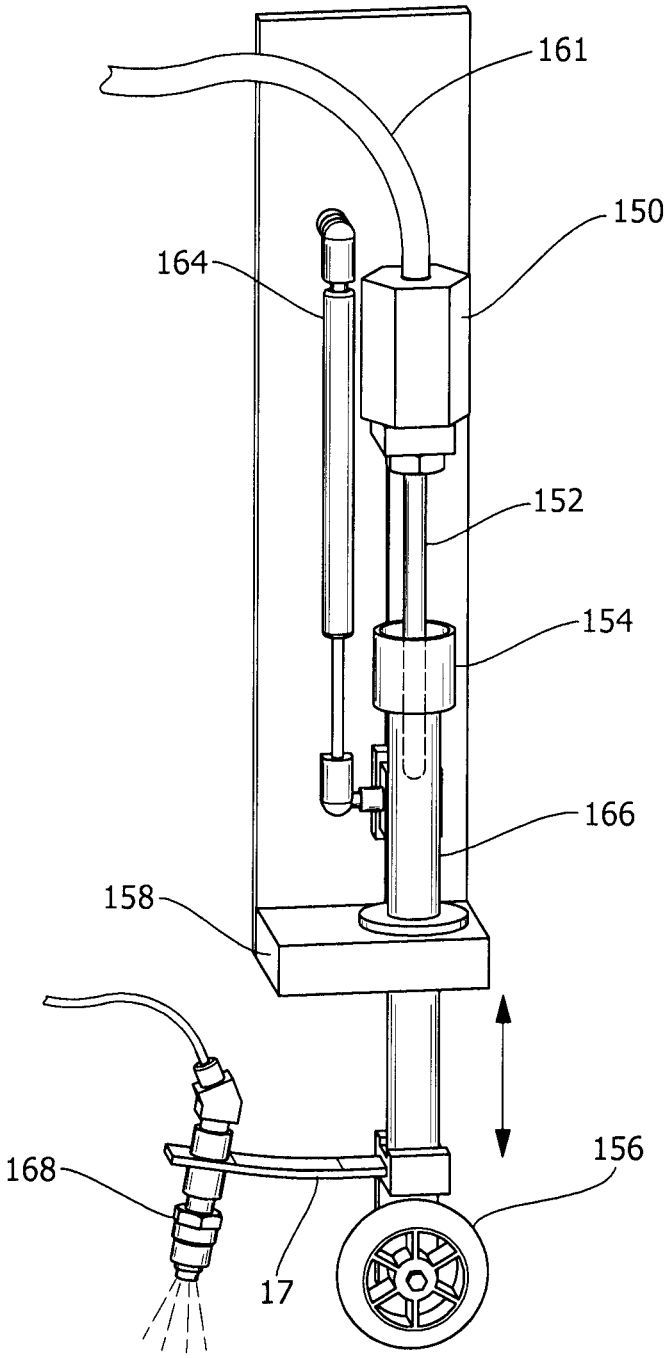
FIG. 8 is a detailed view of a distance or displacement sensor.

Referring next to FIGS. 7 and 8, another embodiment is shown in which roller-type distance sensors are used to determine the elevation of the road surface and, optionally, the depth d of the groove 64. Distance sensors 160 (FIG. 8) are mounted on housing 5. Distance sensors 160 include a linear displacement sensor (LDS) 150, e.g., a linear position transducer, linear encoder or linear potentiometer. In one embodiment LDS 150 may be a linear position transducer manufactured by Balluff, GmbH of Neuhausen, Germany. LDS 150 is attached to a shaft 152, and a magnet 154 is attached to one end of tube 166. Magnet 154 and tube 166 have a hollow bore to receive a portion of shaft 152. Shaft 152 includes internal circuitry arranged to generate an electromagnetic signal to LDS 150 in response to axial movement or displacement of magnet 154 relative to shaft 152. Tube 166 is connected at the opposite end to a roller 156. Roller 156 is placed in contact with a surface as cutting apparatus 61 travels along the roadway. Roller 156 follows the profile of the surface, and causes up or down movements of magnet 154 along shaft 152 which in turn induces a signal detectable by LDS 150. The induced signal indicates precisely the amount and direction of movement of the roller on the road surface. LDS 150 may be connected to controller via data cable 161. If the LDS 150 sense a deviation in the road elevation from the original calibration point the controller receives a feedback signal indicating the deviation and adjusts the depth of the cut accordingly.

A shock absorber or air cylinder 164 may be connected to a tube 166 to apply steady downward force to roller 156, and to dampen the movement of shaft 152. A nozzle 168 may be mounted to a platform 167 adjacent shaft 152 and forward of roller 156, near the road surface, to apply a stream of pressurized air to clear debris from the path of roller 156. A base frame 158 is provided to support distance sensor 160, 162, and align tube 166 with shaft 152, while allowing tube 166 freedom to move vertically with respect to frame 158.

A first distance sensor 160 is mounted forward of cutting drum 3 and aft of roller 6, and senses the road surface height relative to a fixed point on cutting apparatus 61. LDS 150 transmits a signal to controller 55 to calibrate the surface level before commencing a surface grinding operation. A distance sensor or sensors 160 may be mounted on either or both sides of cutting apparatus 61.

In the case where two distance sensors 160 are used, each sensor is aligned with the other in the direction of travel on opposite sides of cutting apparatus 61. Two LDS signals may be advantageous for eliminating spurious signals that may occur, e.g., by road conditions. Since most paved road surfaces are generally even, LDS 150 on both sides of cutting apparatus 61 may generate substantially similar distance signals, e.g., within 2 mm. If within a predetermined tolerance, the two signals may be processed by controller 55 by averaging the distance signals. When surface conditions or equipment malfunctions create a significant deviation between the respective LDS output signals, e.g., where one roller drops into a storm drain or opening in the roadway, the controller 55 may be programmed to disregard the aberrant displacement value—i.e., the signal with the greater amplitude of the two, and accept the lower displacement value of the two. As described above with respect to FIG. 2, controller 55 is programmed to raise and lower cutting drum 3 in response to roller movements to maintain a constant depth of groove 64.

Optionally, a third, or rear, displacement sensor 162 may be mounted on rear sidewall 13, aft of cutting drum 3, approximately centered with respect to the groove 64. Distance sensor 162 senses the distance to the bottom of groove by measuring linear displacement of magnet 154 in response to movement of roller 156. Controller 55 calculates the depth of groove 64 as the difference between the original surface measurement from first distance sensor 160 and the groove surface measurement from second distance sensor 162. A delay interval may be included to synchronize the respective depth measurements based on the speed of travel of cutting machine 1 and the linear offset between distance sensor 160 and distance sensor 162.

Rear laser sensor 62 provides a feedback signal of the actual depth of the groove cut into the surface, and enables adjustment of the cylinder or actuator to account for, e.g., tooth wear of cutting drum 3, road conditions such as variations in hardness, etc. Cylinder 43 may also be equipped with a transducer (not shown) for providing a feedback signal to controller 55 indicating a position of cutting drum 3.

A groove 64 may be continuous or may be a pattern or series of grooves, such as are commonly painted on roadway lines between traffic lanes. When cutting a discontinuous pattern of grooves, a reflectivity sensor may be used to detect the presence or absence of painted road stripes and to distinguish the painted surface from unpainted pavement. In one embodiment cutting machine 1 may include a reflectivity sensor 170 mounted on top of cutting apparatus 61 and having a cable 172 routed through the cutting apparatus 61 to an optical sensor head 174. Optical sensor head 174 transmits a signal to reflectivity sensor 170, and reflectivity sensor 170 determines based on threshold settings when cutting machine 1 travels over a painted portion of the roadway. Reflectivity sensor in turn signals controller to engage the cutting drum 3 at the starting point of the detected paint surface, and continue cutting the pavement.

While the exemplary embodiments illustrated in the figures and described herein are presently preferred, it should be understood that these embodiments are offered by way of example only. Accordingly, the present application is not limited to a particular embodiment, but extends to various modifications that nevertheless fall within the scope of the appended claims. The order or sequence of any processes or method steps may be varied or re-sequenced according to alternative embodiments.

The present application contemplates methods, systems and program products on any machine-readable media for accomplishing its operations. The embodiments of the present application may be implemented using existing computer processors, or by a special purpose computer processor for an appropriate system, incorporated for this or another purpose or by a hardwired system.

It is important to note that the construction and arrangement of the cutting machine and associated controls, as shown in the various exemplary embodiments is illustrative only. Although only a few embodiments have been described in detail in this disclosure, those who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present application. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating conditions and arrangement of the exemplary embodiments without departing from the scope of the present application.

As noted above, embodiments within the scope of the present application include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions comprise, for example, instructions and data which cause a general purpose computer, special purpose computer, or special purpose processing machines to perform a certain function or group of functions.

It should be noted that although the figures herein may show a specific order of method steps, it is understood that the order of these steps may differ from what is depicted. Also two or more steps may be performed concurrently or with partial concurrence. Such variation will depend on the software and hardware systems chosen and on designer choice. It is understood that all such variations are within the scope of the application. Likewise, software implementations could be accomplished with standard programming techniques with rule based logic and other logic to accomplish the various connection steps, processing steps, comparison steps and decision steps.

The invention claimed is:

1. An apparatus for cutting grooves in a surface, comprising:

a housing having a rotatable cutting head mounted therein, an actuator for driving the cutting head out of and into contact with the surface; at least one distance sensor disposed on the housing for sensing a surface height relative to a fixed point on the apparatus, an encoder and a controller;

the controller configured to:

receive a first signal from the encoder indicative of a distance traveled along the surface and control the depth of the groove based on the signal from the encoder;

receive a second signal from the at least one distance sensor; compare the sensed depth of the groove with a predetermined reference depth, and adjust a position of the actuator to maintain the depth of the groove at about the reference depth;

wherein the at least one distance sensor is a linear displacement sensor mounted on a housing of the cutting apparatus; and a transducer, the transducer comprising:

a shaft having internal circuitry arranged to generate an electromagnetic signal to the linear displacement sensor in response to axial displacement of a magnet relative to the shaft the magnet attached to a vertical member connected at a distal end to a roller, wherein the roller is in direct contact with a surface and the roller arranged to follow the surface, and cause movement of the vertical member and the magnet to induce the electromagnetic signal;

a force application device connected to the vertical element to apply a downward force to the roller to maintain the roller in contact with the surface; and a nozzle mounted to a platform and forward of the roller to apply pressurized air to clear debris from a path of the roller.

2. The apparatus of claim 1, wherein the at least one distance sensor includes a distance sensor mounted forward of the cutting head and a distance sensor mounted aft of a roller.

3. The apparatus of claim 1, wherein the at least one distance sensor transmits a signal to the controller for calibrating a surface height before commencing a surface grinding operation.

4. The apparatus of claim 1, wherein a signal indicative of an elevation change in the road surface is transmitted via the at least one distance sensor to the controller and a cutting head position is controlled in response to the signal to maintain a substantially constant depth of the groove in relation to the surface as the groove is cut into the surface.

5. The apparatus of claim 1, further comprising a second distance sensor disposed aft of the cutting head, the distance sensor configured to sense an actual distance to the bottom of the groove and generate a second feedback signal to the controller to indicate the actual depth of the groove.

6. The apparatus of claim 1, wherein the distance sensor is a laser sensor comprising a laser beam, the laser beam directed at the surface for measuring a height of the surface before and after grinding, and wherein the electronic pulse is a laser pulse.

7. The apparatus of claim 1, wherein the distance sensor is a non-contact-type distance sensor such as a laser sensor, ultrasonic sensor, radar, sonar or similar non-contact sensor.

8. The apparatus of claim 1, wherein the vertical member comprises a tube with the magnet attached to an end of the tube;

the magnet and the tube comprising a hollow bore configured to receive the shaft with the shaft passing adjacent to the magnet and into the tube.

9. The apparatus of claim 1, , wherein the shaft further comprises circuitry to generate an electromagnetic signal to the linear displacement sensor in response to an axial displacement of the magnet relative to the shaft.

10. The apparatus of claim 1, wherein the at least one distance sensor comprises a pair of distance sensors aligned in parallel in the direction of travel on opposite sides of the apparatus, the pair of distance sensors arranged to generate simultaneous distance signals to the controller; the controller arranged to adjust the cutting head based on an average distance signal of the simultaneous distance signals if the simultaneous distance signals are within a predetermined tolerance parameter; and to adjust the cutting head based on the lower value of the simultaneous distance signals when the difference of the simultaneous distance signals is greater than the predetermined tolerance parameter.

11. The apparatus of claim 1, the force application device comprising a shock absorber or air cylinder device connected to the vertical element, the device arranged to apply steady downward force to the roller to dampen the movement of shaft.

12. The apparatus of claim 1, further comprising a reflectivity sensor mounted on the cutting apparatus and a cable connecting an optical sensor head in data communication with the reflectivity sensor, the optical sensor head configured to transmit a reflectivity signal to reflectivity sensor; the reflectivity sensor configured to detect a painted portion of the roadway, and to generate the reflectivity signal to the controller to engage the cutting drum at the starting point of the detected paint surface, and continue cutting the pavement until the paint surface ends.

13. A method for controlling the depth of grooves cut in a roadway by a cutting apparatus, the method comprising:

specifying a depth dimension for a groove in a surface, the depth representing a distance between the surface and a bottom of the groove;

providing at least one distance sensor on a cutting apparatus having a rotary cutting drum;

generating a signal indicative of the surface level;

adjusting a position of the rotary cutting drum in response to the signal; and cutting a groove with the cutting apparatus:

setting a depth reference value;

cutting a groove in the surface with a cutting head by controlling a feedback valve;

comparing a front distance surface reading with a rear distance groove bottom reading corresponding to a synchronized linear point of travel using a time delay to register the synchronized linear point travel of the distance readings; and adjusting the position of the cutting head in response to sensing a difference between a reference depth value and an actual depth value.

14. The method of claim 13, further comprising:

sensing a depth of the groove; and transmitting a feedback signal from the at least one distance sensor to a controller configured to control the depth of the groove.

15. The method of claim 14, further comprising:

adjusting an actuator in response to the feedback signal indicating a difference between the depth of the groove and a reference value.

16. An apparatus for cutting grooves in a surface, comprising:

a housing having a rotatable cutting head mounted therein, an actuator for driving the cutting head out of and into contact with the surface; at least one distance sensor disposed on the housing for sensing a surface height relative to a fixed point on the apparatus, an encoder and a controller;

the controller configured to:

receive a signal from the at least one distance sensor; compare the sensed depth of the groove with a predetermined reference depth, and adjust a position of the actuator to maintain the depth of the groove at about the reference depth;

wherein the at least one distance sensor sends an electronic pulse in a narrow beam pointing directly at the surface and measures the time for the electronic pulse to be reflected by the surface and returned to the at least one distance sensor to calculate an actual depth as the difference between the original surface and the groove depth.

17. The apparatus of claim 16, wherein the at least one distance sensor sends a laser pulse in a narrow beam towards the object and measures the time taken by the pulse to be reflected off the surface and returned to the laser sensor to calculate the actual depth as the difference between the original surface and the groove surface measurements.

18. The apparatus of claim 16, wherein the distance sensor is a non-contact-type distance sensor such as a laser sensor, ultrasonic sensor, radar, sonar.

* * * * *